US008984775B2

(12) United States Patent
Dombrow et al.

(10) Patent No.: US 8,984,775 B2
(45) Date of Patent: Mar. 24, 2015

(54) ENERGY RETURN MEMBER FOR FOOTWEAR

(75) Inventors: David Dombrow, Baltimore, MD (US); Heather Pieraldi, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 355 days.

(21) Appl. No.: 13/468,522

(22) Filed: May 10, 2012

(65) Prior Publication Data

US 2013/0219752 A1 Aug. 29, 2013

Related U.S. Application Data

(63) Continuation of application No. 13/404,247, filed on Feb. 24, 2012.

(51) Int. Cl.
*A43B 7/14* (2006.01)
*A43B 23/02* (2006.01)

(52) U.S. Cl.
CPC ..... *A43B 23/0295* (2013.01)
USPC ..... 36/102; 36/107; 36/30 R; 36/142; 36/76 R

(58) Field of Classification Search
USPC ..... 36/102, 107, 30 R, 27, 28, 76 R, 36/142–144
See application file for complete search history.

(56) References Cited

U.S. PATENT DOCUMENTS 4,843,737 A 7/1989 Vorderer
4,858,338 A 8/1989 Schmid
6,199,303 B1 * 3/2001 Luthi et al. ..... 36/31
6,282,814 B1 9/2001 Krafsur et al.
6,393,731 B1 5/2002 Moua et al.
6,449,878 B1 9/2002 Lyden
6,477,791 B2 * 11/2002 Luthi et al. ..... 36/31
6,502,330 B1 * 1/2003 David et al. ..... 36/88
6,954,998 B1 * 10/2005 Lussier ..... 36/107
7,204,042 B2 4/2007 Aveni
7,434,337 B2 10/2008 Gibert et al.
7,886,460 B2 2/2011 Teteriatnikov et al.
7,900,377 B1 3/2011 Perenich
7,905,033 B1 3/2011 Perenich
7,913,422 B1 3/2011 Perenich
8,186,081 B2 * 5/2012 Wilson et al. ..... 36/76 R
8,341,856 B2 * 1/2013 Smith et al. ..... 36/25 R
2001/0001907 A1 * 5/2001 Luthi et al. ..... 36/88
2001/0007177 A1 7/2001 Brown et al.
2002/0174567 A1 11/2002 Krafsur et al.
2004/0000074 A1 1/2004 Auger et al.
2005/0108897 A1 5/2005 Aveni
2005/0246922 A1 11/2005 Gibert et al.

(Continued)

OTHER PUBLICATIONS

Kolecki, Catherine, "Running Shoe: How Products are Made," Enotes, 2011, <http://www.enotes.com/how-products-encyclopedia/running-shoe>.

*Primary Examiner* — Marie Bays
(74) *Attorney, Agent, or Firm* — Maginot, Moore & Beck LLP

(57) ABSTRACT

In at least one embodiment, an article of footwear includes a sole defining a lateral side and a medial side, an upper attached to the sole, and a resilient member positioned within the sole. The resilient member includes a plurality of arms including a medial arm extending along the medial side of the sole and a lateral arm extending along the lateral side of the sole, wherein an end of the medial arm is connected to an end of the lateral arm.

19 Claims, 12 Drawing Sheets

(56) References Cited

U.S. PATENT DOCUMENTS

| | | | | |
|---|---|---|---|---|
| 2006/0156580 | A1 | 7/2006 | Russell | |
| 2006/0162190 | A1 | 7/2006 | Nishiwaki et al. | |
| 2006/0174515 | A1 | 8/2006 | Wilkinson | |
| 2008/0078103 | A1 | 4/2008 | Liles | |
| 2008/0250668 | A1 | 10/2008 | Marvin et al. | |
| 2009/0178303 | A1 | 7/2009 | Hurd et al. | |
| 2009/0217551 | A1 | 9/2009 | Shirokikh | |
| 2009/0320330 | A1* | 12/2009 | Borel et al. | 36/30 R |
| 2010/0293816 | A1* | 11/2010 | Truelsen | 36/30 R |
| 2010/0307025 | A1* | 12/2010 | Truelsen et al. | 36/28 |
| 2011/0047816 | A1 | 3/2011 | Nurse | |
| 2012/0159814 | A1* | 6/2012 | Smith et al. | 36/92 |

* cited by examiner

ENERGY RETURN MEMBER FOR FOOTWEAR

CROSS-REFERENCE TO RELATED APPLICATIONS

This application is a continuation of U.S. patent application Ser. No. 13/404,247, filed Feb. 24, 2012.

FIELD

The present disclosure relates generally to articles of footwear, and, more particularly, to resilient members incorporated in the soles of footwear.

BACKGROUND

Footwear, particularly athletic footwear, is worn in a variety of activities including running, walking, hiking, other team and individual sports, and any activity where the protection and support of human feet is desired. In one configuration, an article of footwear includes a sole and an upper that form a cavity in which a user places his or her foot. The sole of the footwear engages the bottom of the foot and separates the foot from the ground. The sole often consists of one or more layers of materials including leather, rubber, foam, and plastics that provide shock absorption and support to the foot. The upper extends outwardly from an outer peripheral edge of the sole and covers at least a portion of the foot to hold the footwear in place. Uppers in athletic shoes are usually formed from one or more pieces of fabric, leather, and/or plastic that are stitched or otherwise attached together. Various fasteners including shoelaces and hook and loop fasteners are used to secure the foot in place within the footwear.

In an article of footwear, the sole provides cushioning and support for the foot and helps to maintain traction between the foot and the ground while running or walking. The sole deforms as the shape of the foot changes during each stride, and then returns to an undeformed configuration as the foot leaves the ground.

Proper engagement between the foot and the upper and sole of the shoe can improve the comfort and protection that the shoe provides to a wearer. The human foot has various sections including the forefoot, midfoot, and heel. During walking or running, the human foot transfers energy into the ground through the sole. Some mechanical energy is also stored in the sole as the sole deforms during a stride, and the mechanical energy is released as the foot and the sole leave the ground. Thus, improvements to footwear that enable each section of the foot to engage the footwear comfortably and improvements that reduce the effort needed to walk or run while wearing the footwear would be beneficial.

SUMMARY

In at least one embodiment, an article of footwear includes a sole defining a lateral side and a medial side, an upper attached to the sole, and a resilient member positioned within the sole. The resilient member includes a plurality of arms including a medial arm extending along the medial side of the sole and a lateral arm extending along the lateral side of the sole, wherein an end of the medial arm is connected to an end of the lateral arm.

In at least one other embodiment, an article of footwear includes an upper, a sole attached to the upper, and a spring plate embedded in the sole. The sole includes a forefoot region, a midfoot region, and a heel region. The spring plate includes a first cantilever arm, a second cantilever arm, and a central portion. The first and second cantilever arms extend from the midfoot region into the forefoot region of the sole.

In at least one other embodiment, an article of footwear configured for a foot of a human wearer includes a sole, an upper attached to the sole, and a spring plate positioned within the sole. The sole includes a medial side and a lateral side and further includes a forefoot region and a heel region. The upper and sole define a foot cavity configured to receive the foot. The spring plate includes a central member positioned posterior to the forefoot region of the sole, a first medial arm extending from the central member to the forefoot region of the sole on a medial side of the sole, a first lateral arm extending from the central member to the forefoot region of the sole on a lateral side of the sole, and at least one posterior arm extending from the central member to the heel region of the sole. The first medial arm and the first lateral arm are configured to resiliently deform in response to a force on the sole during a stride of the wearer and resiliently recover in response to the force being removed from the sole.

The above described features and advantages, as well as others, will become more readily apparent to those of ordinary skill in the art by reference to the following detailed description and accompanying drawings. While it would be desirable to provide an apparatus that provides one or more of these or other advantageous features as may be apparent to those reviewing this disclosure, the teachings disclosed herein extend to those embodiments which fall within the scope of any appended claims, regardless of whether they include or accomplish one or more of the advantages or features mentioned herein.

DETAILED DESCRIPTION

Figure 1:
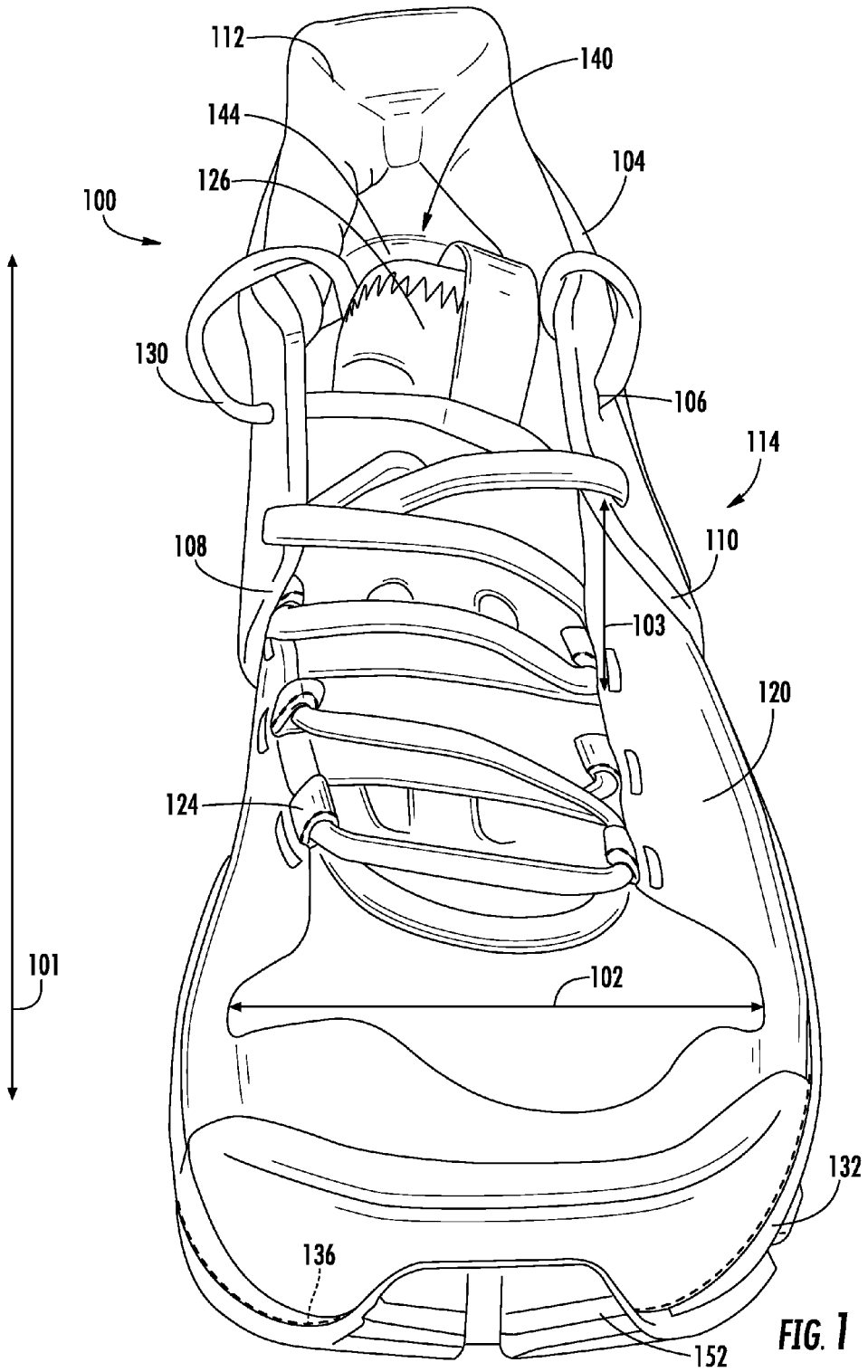
FIG. 1 is a front perspective view of an athletic shoe.

For a general understanding of the details for the footwear disclosed herein, the drawings are referenced throughout this document. In the drawings, like reference numerals designate like elements. As used herein the term "foot" may refer to a portion of the human foot, a full human foot, and to the ankle. Various portions of the foot include, but are not limited to, the forefoot, midfoot, upper foot, heel, and ankle. As used in this document, the heel is considered to be the posterior end of the foot and the portion of an article of footwear that engages the heel is the posterior end of the article of footwear. The toes of the foot and toe-end of the article of footwear are considered to be the anterior ends of the foot and article of footwear, respectively. The terms "medial" and "medial side" refer to the inner side of a foot extending from the large toe to the heel, and the terms "lateral" and "lateral side" refer to the outer side of the foot extending from the small toe to the heel. Similarly, articles of footwear include medial and lateral sides that conform to the medial and lateral sides, respectively, of the foot. Some footwear embodiments include different contours on each of the medial and lateral sides to improve the fit of the footwear to the foot. The term "user" may refer to a person wearing an article of footwear.

The terms "forefoot" "midfoot" and "heel" as used herein with reference to an article of footwear refer to regions of the footwear configured to engage the forefoot, midfoot, and heel, respectively, of a human foot when a human wears the article of footwear. As used herein, the forefoot of a human foot includes the phalange bones that form the toes, the midfoot is the region posterior from the forefoot that includes the metatarsal bones, and the heel includes the posterior end of the foot including the tarsus bones.

Figure 12:
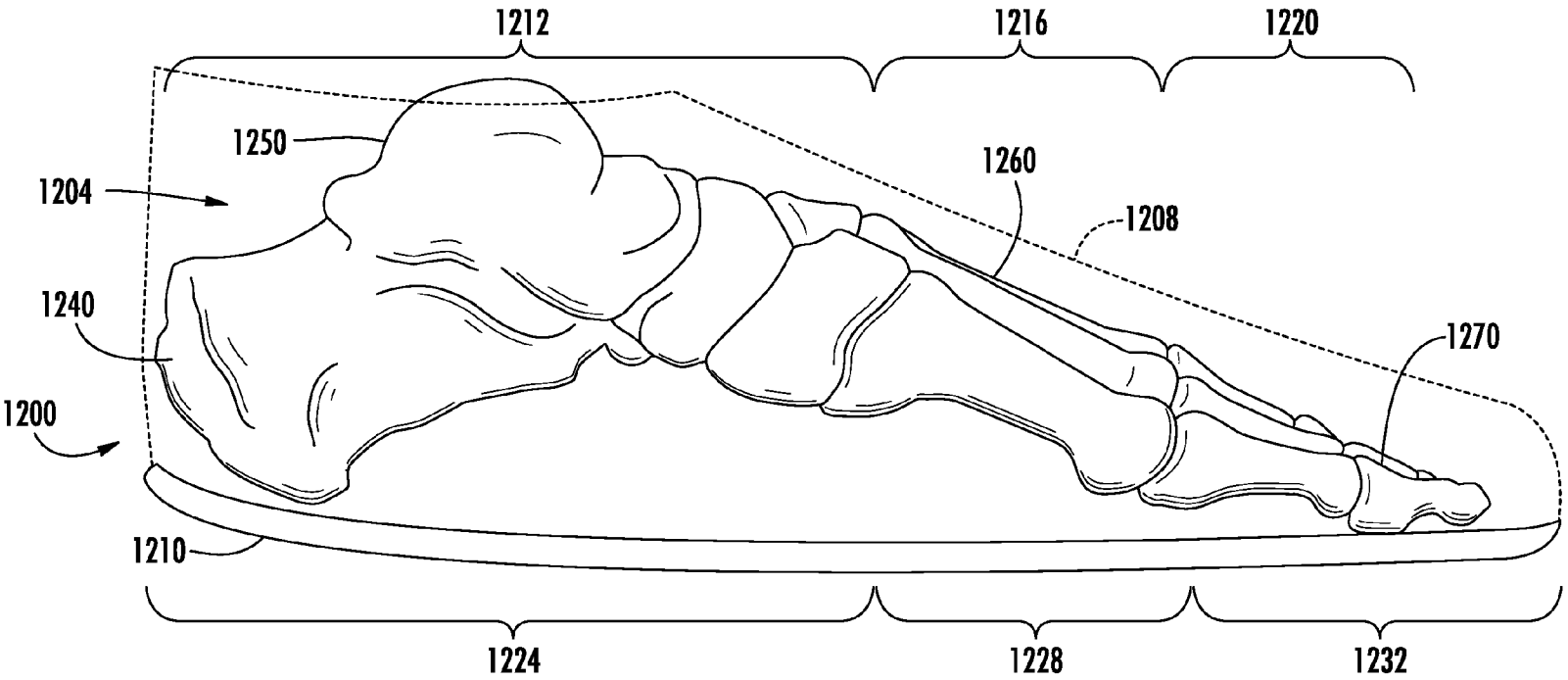
FIG. 12 PRIOR ART
FIG. 12 is a prior art view of the bones of a human foot and a sole of a shoe.

Various articles of footwear may engage only portions of each section of the foot. For example, a low-top athletic shoe may not engage portions of the heel including the calcaneus and talus bones, or an open-toed shoe may not directly engage each of the phalanges in the toes of the wearer. FIG. 12 depicts a prior art article of footwear 1200 with a skeletal view of a human foot 1204 positioned in the footwear 1200. The foot 1204 includes a heel 1212, midfoot 1216, and forefoot 1220. The footwear 1200 includes an upper 1208, depicted in dashed lines, and a sole 1210. The upper 1208 and sole 1210 include a heel region 1224, midfoot region 1228 and forefoot region 1232 that engage the heel 1212, midfoot 1216, and forefoot 1220 of the foot 1204, respectively. As described in more detail below, a single section of the shoe may engage more than one portion of the foot. For example, a sole of the shoe can engage an entire ventral portion of the human foot. A forefoot section of the upper of a shoe can engage some or all of the sides and dorsal (top) surface of the forefoot and midfoot, and a heel section of the upper can engage some or all of the sides of the heel and sides and dorsal surface of the midfoot.

General Arrangement of The Article of Footwear

FIG. 1-FIG. 6 depict different views of one embodiment of footwear, shown as an athletic shoe 100 that is configured to be worn on a left human foot. The athletic shoe 100 includes a sole 132 and an upper 114 formed from a heel member 104 and forefoot member 120. In the upper 114, the heel member 104 covers at least a portion of the heel region and midfoot region of the athletic shoe 100, and the forefoot member 120 covers at least a portion of the forefoot region and midfoot region of the athletic shoe 100. The athletic shoe 100 has a length depicted along axis 101 and a width depicted along axis 102. The sole 132, heel member 104, and forefoot member 120 form a foot cavity 140 with an opening formed by the heel member 104 and a tongue 126 that is attached to the forefoot member 120. A user inserts his or her foot into the foot cavity 140 when putting on the shoe, with the toes and forefoot moving forward in the foot cavity 140 to engage the forefoot member 120, while the heel and a portion of the midfoot engage the heel member 104. In the embodiment of the athletic shoe 100, an insole 144 positioned at the top of the sole 132 engages the bottom of the foot in the foot cavity 140. The heel member 104, forefoot member 120 cover at least a portion of the top, sides, and posterior of the foot in the foot cavity 140 to hold the athletic shoe firmly in place on the foot. The sole 132 covers the bottom of the foot in the foot cavity to provide support and cushioning to the foot while the user wears the athletic shoe 100. The upper 114 and the sole 132 envelop the human foot and provide protection and support for the human foot in the foot cavity 140 during a wide range of activities including athletic activities. As used herein, the term "envelop" refers to a complete or substantially complete enclosure of a human foot, allowing for a possible exception of an insubstantial portion of the foot not being covered, such as a small region below the ankle or other insubstantial uncovered portion. Accordingly, most convention running shoes would envelop the human foot while conventional sandals would not envelop the human foot.

Referring FIG. 1, the upper 114 is depicted along the length 101 of the athletic shoe 100. The forefoot member 120 is attached to the sole 132 and extends from the forefoot of the shoe 100 through a portion of the midfoot. The heel member 104 is attached to the sole 132 and extends from the heel of the shoe 100 to the midfoot. In the athletic shoe 100, a portion of the forefoot member 120 and heel member 104 overlap in the midfoot region. The heel member 104 is positioned on the exterior of the forefoot member 120 in this overlapping region. FIG. 1 depicts a medial leading edge 108 and lateral leading edge 110 of the heel member 104. The forefoot member 120 extends past the medial leading edge 108 and lateral leading edge 110 of the heel member 104 toward the heel of the athletic shoe 100, and the heel member 104 covers the forefoot member 120 in the overlapping region of the upper 114.

The heel upper 114 is typically formed from one or more layers of various materials including fabrics, natural or synthetic leather, natural and synthetic rubber, foams, and plastics. In the athletic shoe 100, the heel member 104 includes a posterior cushioning member 112 that engages the posterior of the heel and includes a fabric layer covering a foam layer that cushions the foot. Various types of synthetic fabric including nylon, polytetrafluoroethylene (sold commercially as Gore-Tex®), and HeatGear®, sold by Under Armour, Inc. of Baltimore, Md., can be used in forming the upper members 104 and 120. The heel member 104 and forefoot member 120 can also include rigid or semi-rigid components such as thermoplastic or metal supports that resist bending and provide support to the foot.

Figure 2:
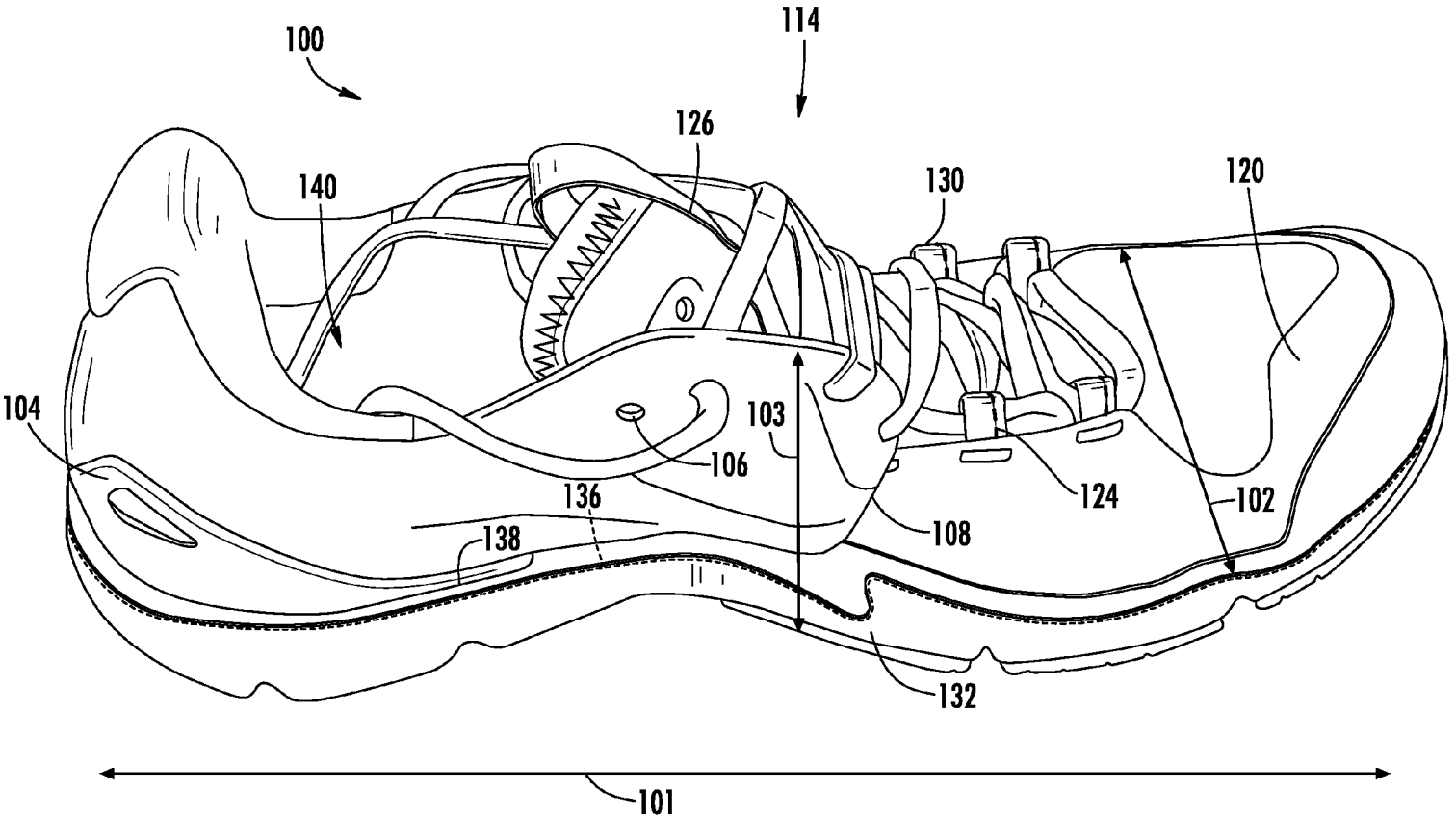
FIG. 2 is a medial-side perspective view of the athletic shoe of FIG. 1.
Figure 3:
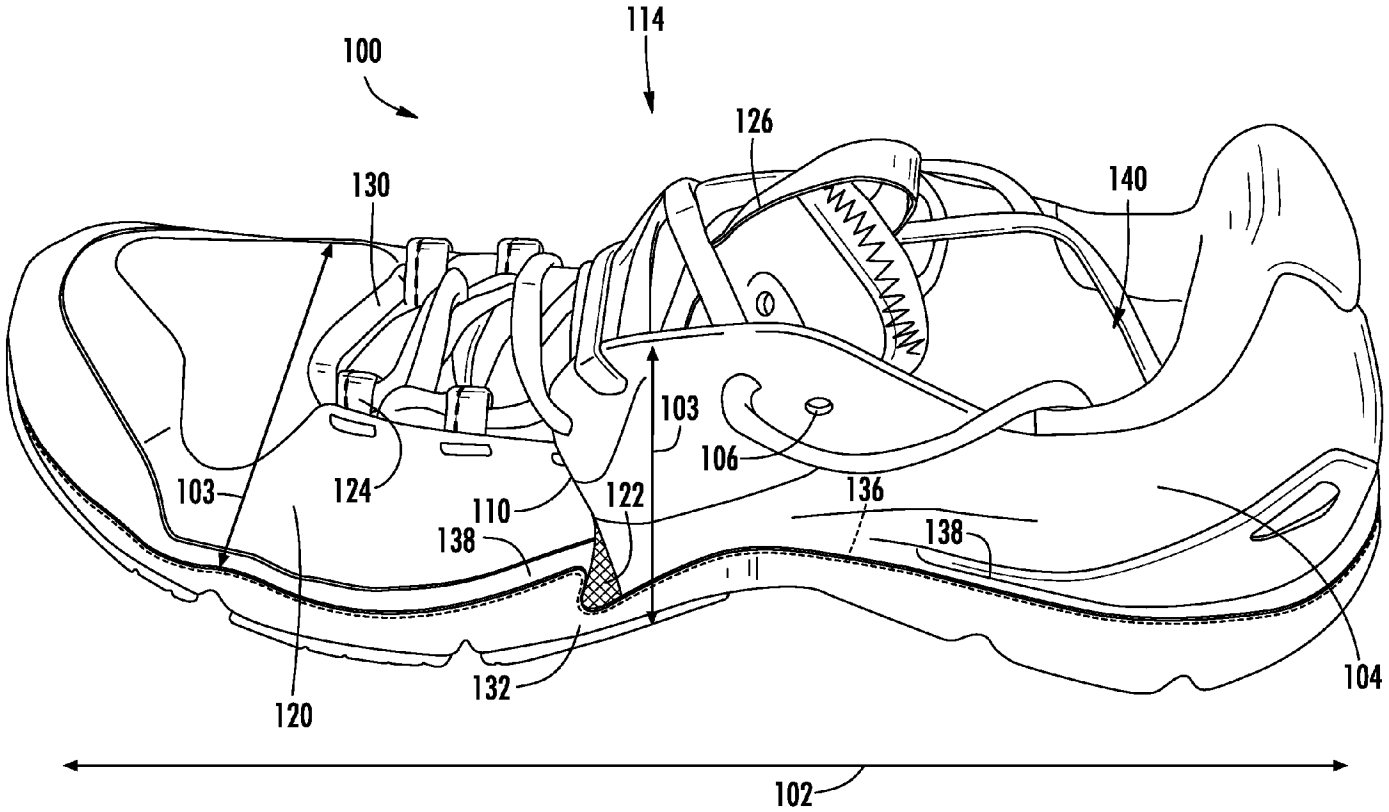
FIG. 3 is a lateral-side perspective view of the athletic shoe of FIG. 1-FIG. 2.

The forefoot member 120 also includes a stretchable fabric section 122 which stretches to accommodate insertion of a foot into the foot cavity 144 and conforms to the top and sides of the foot in the foot cavity 144. The stretchable fabric section 122 can be formed from various materials including elastane fabric. In the athletic shoe 100, the overlap of the heel member 104 over the forefoot member 120 leaves a portion of the stretchable fabric 122 exposed on the lateral side of the athletic shoe 100 as depicted in FIG. 3, while the heel member 104 fully covers the stretchable fabric 122 on the medial side of the athletic shoe 100, as depicted in FIG. 2. Other embodiments include larger or smaller sections of stretchable fabric, or can omit the stretchable fabric.

The forefoot member includes a tongue 126. In the embodiment of the athletic shoe 100, the tongue 126 is attached to the forefoot member 120 around substantially the entire anterior side, lateral side, and medial side of the tongue 126, which are depicted with broken line 128 in FIG. 4 and FIG. 11. At least a portion of the sides of the tongue 128 are attached to the stretchable fabric 122 in the forefoot member 120. In the example of the athletic shoe 100, the tongue 126 is stitched to the forefoot member 120 around the outer perimeter 128, but in other embodiments the tongue is adhered to the forefoot member or formed from an integral piece of material that forms the forefoot member 120. The stretchable fabric 122 enables adjustment of the tongue 126 to improve the fit of the athletic shoe 100, even though the sides of the tongue 126 are attached to the forefoot member 120. In alternative embodiments, the tongue 126 is attached to the forefoot member 120 along the anterior side of the tongue 126 and is substantially detached from the forefoot member 120 along the medial and lateral sides.

Both the heel member 104 and forefoot member 120 include eyelets that accept a single shoe lace 130 that laces the heel member 104 and forefoot member 120 together in the athletic shoe 100. In the embodiment of FIG. 1, the forefoot member includes a plurality of eyelets 124 formed from fabric loops that are positioned on the lateral and medial sides of the tongue 126. The heel member 104 includes eyelet holes 106 that are formed through the material of the heel upper 104. As used herein the term "eyelet" refers to any suitable structure for engaging a shoe lace to an article of footwear. Examples of other eyelet embodiments include hooks and tubular engagement members that accept the shoe lace.

Figure 9:
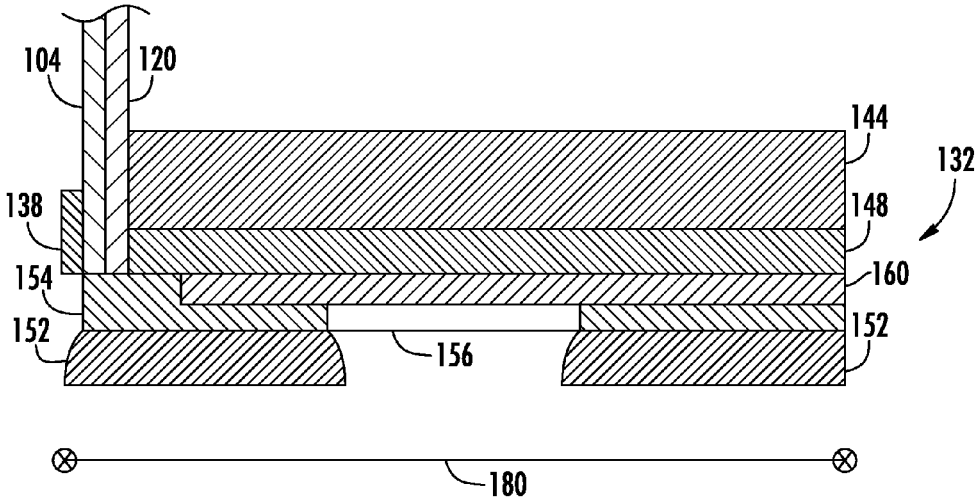
FIG. 9 is a cross-sectional view of layers forming the sole and upper of the athletic shoe of FIG. 1-FIG. 6 taken along line 180 depicted in FIG. 6.
Figure 11:
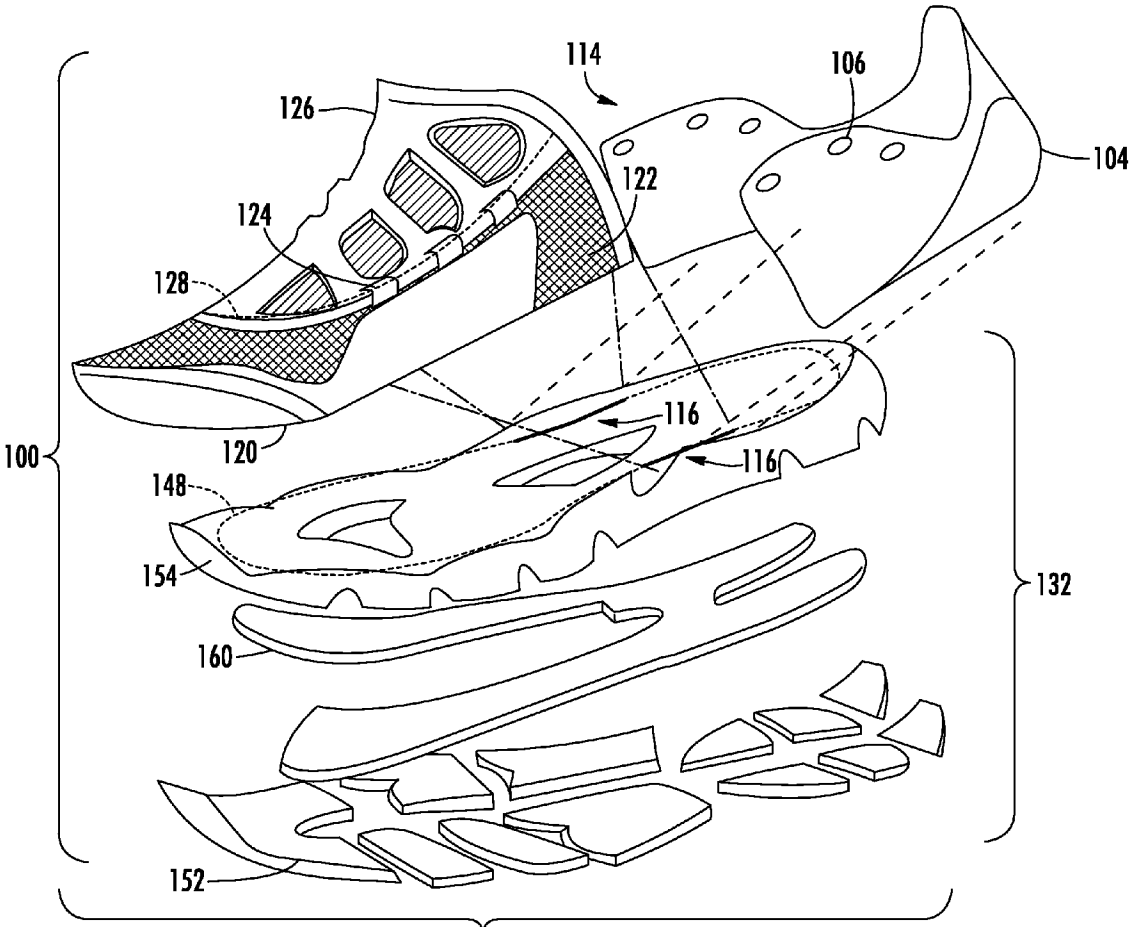
FIG. 11 is an exploded view of the athletic shoe depicted in FIG. 1-FIG. 6.

The sole 132 further includes multiple members that support the bottom of a foot placed in the foot cavity 140. As depicted in FIG. 9 and FIG. 11, the sole 132 includes a midsole board 148, resilient layer 154, energy return plate 160 and treads 152. FIG. 9 also depicts a cushioning insole layer 144 that is positioned above the midsole board 148. In the article of athletic shoe 100, the midsole board 148 is attached to both the heel member 104 and forefoot member 120 in the upper 114. Various alternative embodiments of the sole 132 include additional layers or omit some of the layers described herein.

FIG. 2 and FIG. 3 depict the medial and lateral sides, respectively, of the shoe 100. FIG. 2 and FIG. 3 depict the sole 132 including a welt 138. The welt 138 in the athletic shoe 100 is a black plastic member that is an integral member of the sole 132 that extends upward to provide a surface to attach both the heel member 104 and forefoot member 120 to the sole 132. The welt 138 extends upward around a perimeter of the sole 132 depicted as dashed line 136. Alternative footwear embodiments omit the welt and attach the forefoot and heel members to other layers of the sole 132 directly.

Separate Heel and Forefoot Members

Figure 4:
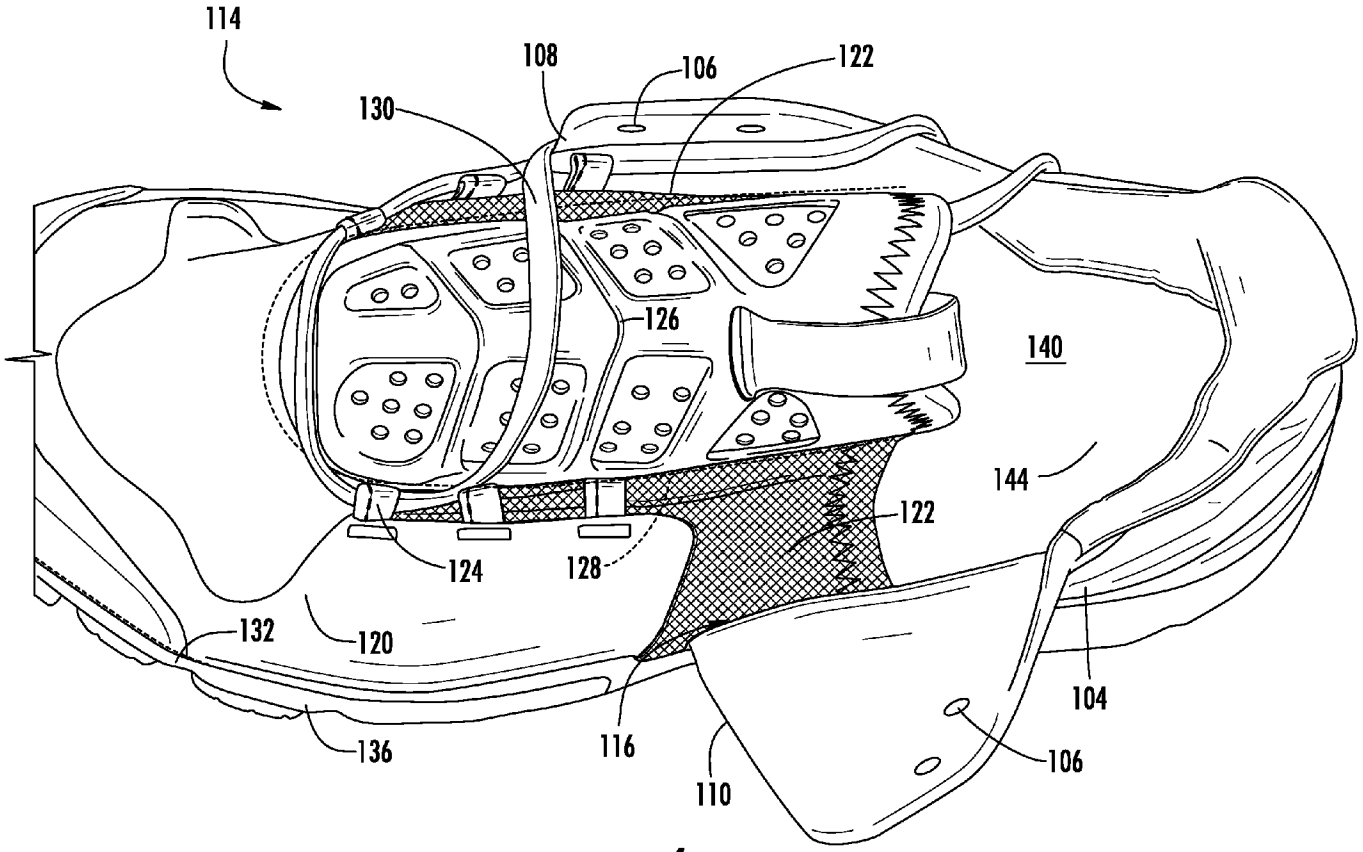
FIG. 4 is a perspective view of the athletic shoe of FIG. 1-FIG. 3 with a portion of a heel member in an upper of the shoe retracted to depict a forefoot member of the upper and the heel member of the upper in greater detail.
Figure 5:
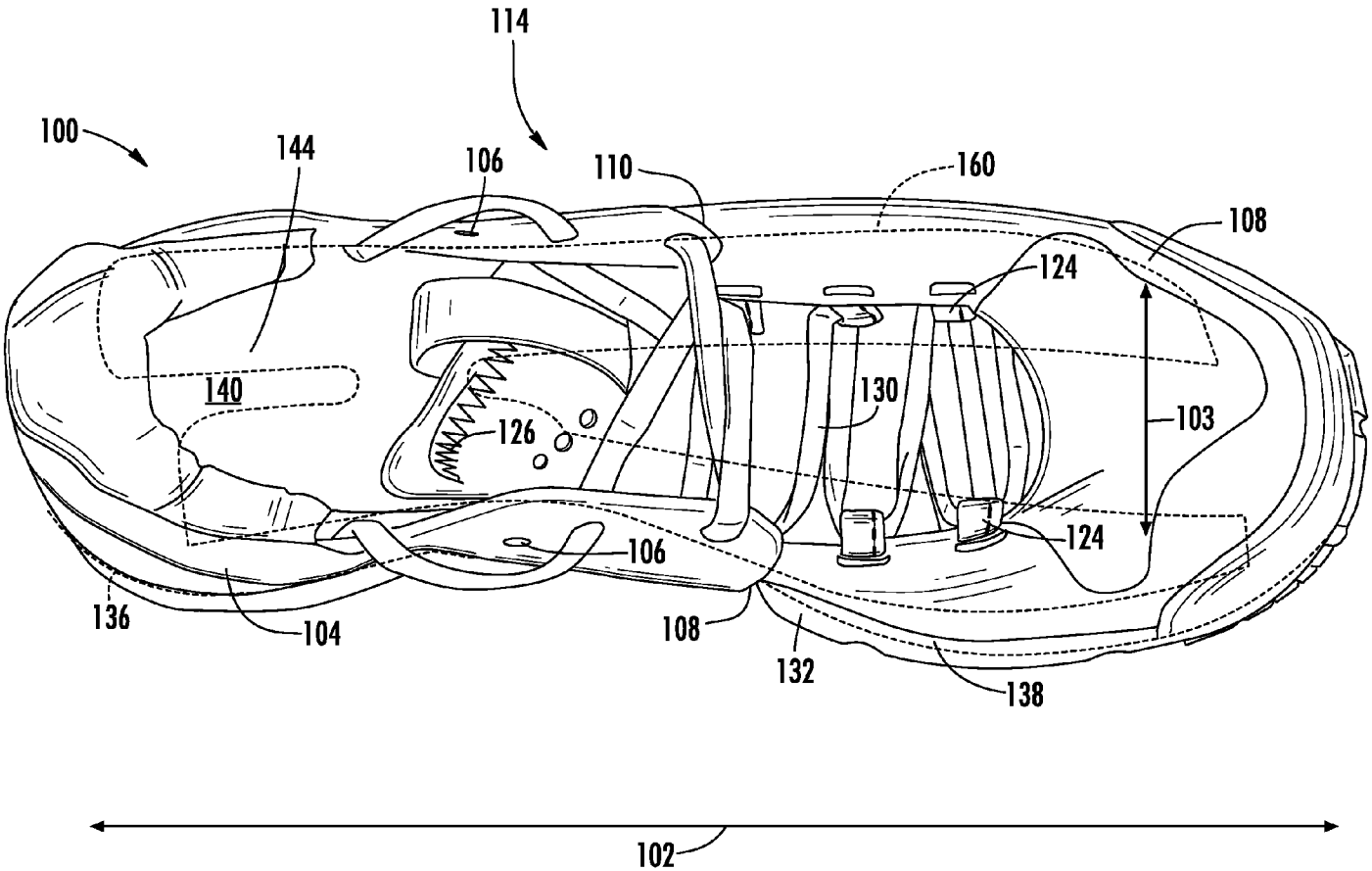
FIG. 5 is a top view of the athletic shoe of FIG. 1-FIG. 4 with an outline view of an energy return plate that is incorporated with a sole of the athletic shoe.

As described above, the heel member 104 and forefoot member 120 are directly attached to one another along a common length 116 of the sole 132, which common length 116 is directly below the overlapping region of the forefoot member 120 and heel member 104 in the upper 114, as best depicted in FIG. 4 and FIG. 11. Notwithstanding this overlap, the heel member 104 is separate from the forefoot member 420 above the sole 132 such that the upper 114 does not provide an attachment between the heel member 104 and the forefoot member 120. In one configuration, the forefoot member 120 is strobled or sewn to the sole 132 first, and the heel member 104 is then strobled or sewn to the sole 132 after the forefoot member, with the overlapping portions of the heel member 104 being strobled to the sole 132 through a portion of the forefoot member 120 along common length 116. Thus, in the athletic shoe 100, the heel member 104 and forefoot member 120 are both attached to the midsole board 148 along a common length 116 of the sole 132 on the medial and lateral sides of the sole 132. However, the heel member 104 and forefoot member 120 are separated from each other above the sole 132. Nevertheless, some overlap between the heel member 104 and the forefoot member 120 generally occurs above the sole 132. As depicted in FIG. 9 and FIG. 11, the forefoot member 120 is attached to the midsole board 148 and the heel member 104 overlaps the forefoot member 120. The strobling process forms stitches through the heel member 104, forefoot member 120, and the midsole board 148 to attach the heel member 104 and forefoot member 120 to the sole 132 along the common length 116 of the sole 132. In other embodiments, the heel member 104 and forefoot member 120 are attached to the sole 132 via adhesives or other fastening means.

When worn on a foot, the shoelace 130 laces through eyelets 124 and 106 in both the forefoot member 120 and heel member 104. The upper 114 does not, however, provide any attachment between the forefoot member 120 and the heel member 104 other than the common length 116 of the sole 132 where the heel member 104 and forefoot member 120 are attached to the sole 132. More specifically, the heel member 104 is not sewn, adhered, or otherwise affixed to the forefoot member 120 above the sole 132, thus enabling the heel member 104 to be moved independent of the forefoot member 120 as depicted in FIG. 4. The shoelace 130 engages the heel member 104 and the forefoot member 120. However, because of the separation between the heel member 104 and forefoot member 120, the heel member 104 and forefoot member 120 can be adjusted independently of one another.

The separate configuration of the forefoot member 120 and the heel member 104 in the upper 114 enables each section of the upper to be adjusted to different parts of a foot individually to improve the fit of the athletic shoe 100. For example, the wearer can pull on the tongue 126 to fit the forefoot member 120 to the forefoot and midfoot while the fit of the heel member 104 remains substantially unchanged. Similarly, adjustments to the heel member 104 do not substantially affect the separate forefoot member 120. When adjusting the shoelace 130, the wearer can selectively loosen or tighten the portions of the shoe lace extending through the eyelets 106 to adjust the fit of the heel member 104, or loosen or tighten portions of the shoe lace 130 extending through the eyelets 124 to adjust the fit of the forefoot member 120.

The athletic shoe 100 shown in FIGS. 1-4 is one example of an article of footwear with separated heel and forefoot members, but it will be recognized that other embodiments are also envisioned. In one alternative embodiment, the heel member 104 is attached to the sole 132 and a portion of the forefoot member 120 overlaps a portion of the heel member 104 (instead of the heel member 104 overlapping the forefoot member 120 as shown in FIGS. 1-4). In another alternative embodiment, the heel member 104 and forefoot member 120 do not overlap on the upper 114 or the sole 132, but are instead attached to separate sections of the perimeter 136 around the sole 132. In still another alternative embodiment, the heel member 104 and forefoot member 120 are attached together above the sole for only a fraction of a height of the two upper members. In one alternative configuration, the heel member 104 is attached to the forefoot member 120 near the medial and lateral leading edges 108 and 110 for a few centimeters or less of a height 103 of the heel member 104 extending upward from the sole 132. Sufficient portions of the partially attached heel member 104 and forefoot member 120 remain detached and overlap each other to enable individual adjustment of the heel member 104 and forefoot member 120 to fit the foot inserted into the foot cavity 140.

Method of Making the Article of Footwear

Figure 7:
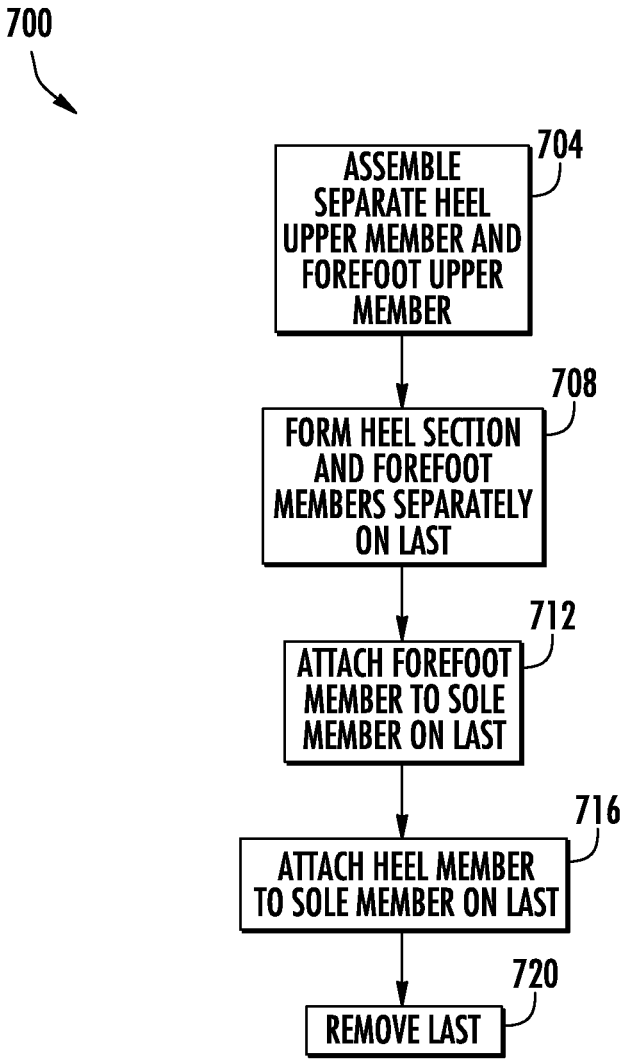
FIG. 7 is a block diagram of a process for producing an article of footwear.

FIG. 7 depicts a process 700 for producing an article of footwear. The athletic shoe 100 described above is one example of an article of footwear that can be produced using process 700, and is described with process 700 for illustrative purposes. Process 700 begins by assembling the heel member 104 and forefoot member 120 as two separate pieces (block 704). The heel and forefoot members can be assembled concurrently or at different times as needed. In one embodiment of process 700, the tongue 126 is attached to the forefoot member 120 as part of the assembly of the forefoot member 120. Various assembly methods known to the art including sewing and adhesion of the various components in each of the heel and forefoot uppers are used to assemble both of the forefoot and upper members. As depicted in FIG. 11, the heel member 104 and forefoot member 120 of the upper 114 are assembled as separate pieces. However, during the process 700, the heel member 104 and forefoot member 120 do not take the shape depicted in the assembled athletic shoe 100 illustrated in FIG. 1-FIG. 5 until engaged with a last as described below.

After assembly, the separate heel and forefoot members lack the shape of an upper in a completed article of footwear. Both the heel member and the forefoot member engage a last that shapes the forefoot and heel members (block 708). A last is a form having a size and shape approximating a size and shape of the foot cavity 140 in the athletic shoe 100. In common manufacturing processes, a last is a shaped plastic or wood form. The heel member 104 and forefoot member 120 are stretched over the last in the shape of the upper in the athletic shoe 100. Some process embodiments also heat the heel and forefoot members as the members are stretched over the last to form the shape of the upper in the completed athletic shoe. The forefoot member 120 engages a forefoot end of the last and stretches toward the heel. The heel member 104 engages a heel end of the last and stretches toward the forefoot. The heel member 104 and forefoot member 120 engage the last separately and are not attached to each other. In the embodiment of athletic shoe 100, a portion of the heel member 104 overlaps a portion of the forefoot member 120 in the midfoot region of the last.

After forming the heel and forefoot members on the last, the forefoot member is attached to a member of the sole (block 712). Some manufacturing processes attach the forefoot member to a midsole board, such as midsole board 148 in the sole 132, which is typically a cardboard or polymer member that conforms to the shape of the sole. The midsole board is positioned on the bottom of the last and the forefoot member is strobled or otherwise attached to the midsole board. In shoes that employ a welt to attach the forefoot member to the sole, the welt is attached to the midsole board and then the forefoot member is attached to the welt. In some embodiments, the midsole board is integrated with other layers in the sole prior to attaching the forefoot member to the midsole board. In other embodiments, the remaining layers of the sole are attached to the midsole board after both the forefoot and heel members of the upper are attached to the midsole board. Some articles of footwear do include a midsole board. Process 700 attaches the upper forefoot member to another one of the layers of the sole for articles of footwear that omit the midsole board.

Process 700 continues by attaching the heel member to a member of the sole (block 716). The heel member is attached to the sole member in a similar manner to the forefoot member. In the example of the athletic shoe 100, one embodiment of process 700 attaches the heel member 104 to the sole member such as the midsole board or another layer of the sole after attaching the forefoot member 120 to the sole member. The heel member 104 is attached after the forefoot member 120 due to the overlap of the heel member 104 outside of a portion of the forefoot member 120. In alternative embodiments, the forefoot member 120 is attached after the heel member 104, or the two members are attached simultaneously. In each alternative embodiment, the forefoot member 120 and the heel member 104 are attached to the sole member 132 without attaching the forefoot member 120 and the heel member 104 above the sole member 132.

After both the forefoot and heel members are attached to a member of the sole, the last is removed from the article of footwear (block 720). In the athletic shoe 100, the heel member 104, forefoot member 120, and sole 132 form the foot cavity 140 that accommodates a foot having a size and shape similar to the last.

Energy Return Plate

Figure 8A:
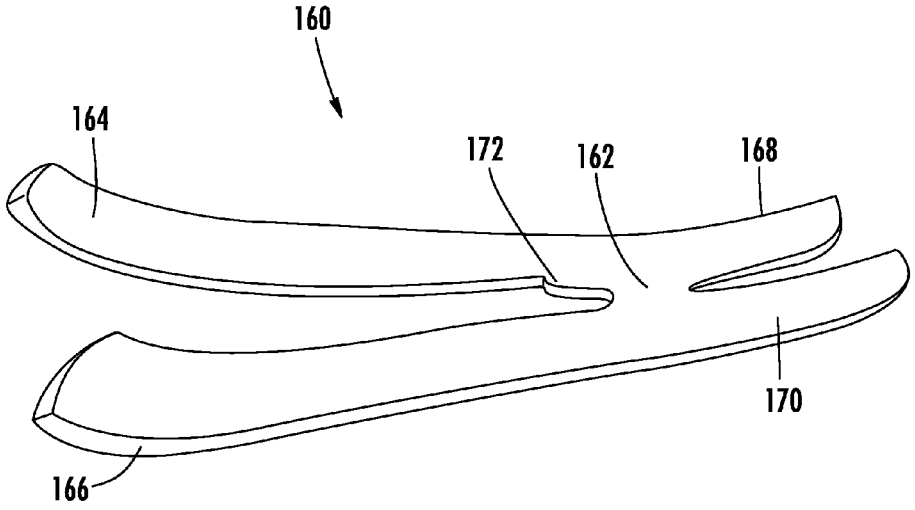
FIG. 8A is a view of one embodiment of an energy return plate that is incorporated in an article of footwear.

In at least one embodiment, the athletic shoe 100 includes an energy return plate 160 integrated within the sole 132 in the athletic shoe 100. With reference to FIG. 8A, the energy return plate 160 includes a central portion 162, medial forefoot arm 164, lateral forefoot arm 166, medial heel arm 168, and lateral heel arm 170. In one alternative embodiment depicted in FIG. 8B, an energy return plate 190 includes a central portion 192, medial forefoot arm 194, lateral forefoot arm 196, and a heel arm 198. During a stride of a human wearing the shoe 100, the energy return plate deforms and absorbs mechanical energy from the stride. As the foot and athletic shoe 100 leave the ground, the energy return plate returns to an un-deformed configuration and returns some of the mechanical energy to the foot. The energy return plate is also referred to as a "spring plate" because the energy return plate includes multiple leaf spring members that store mechanical energy from various regions of the foot during a stride. It will be recognized that although the energy return plate 160 is described herein in association with the athletic shoe 100 having a separate heel member 104 and forefoot member 120 in the upper 114, in other embodiments the energy return plate 160 could be incorporated into a shoe with a conventional or differently constructed upper 114.

With particular reference to FIG. 8A, the medial forefoot arm 164 extends from the central portion 162 along the length of the medial side of the foot cavity to an area of the forefoot region proximate to the hallux (big toe). The lateral forefoot arm 166 extends from the central portion 162 along the length of the lateral side of the foot cavity to an area of the forefoot region proximate the fifth toe (little toe). Each of the medial and lateral forefoot arms 164 and 166 can extend under multiple toes and other regions of the forefoot and midfoot in the foot cavity based on the length and width selected for each arm. The medial heel arm 168 extends in the posterior direction from the central portion 162 toward the heel region along the medial side of the foot cavity and the lateral heel arm 170 extends in the posterior direction from the central portion along the lateral side of the foot cavity. The arms 164, 166, 168, and 170 have an upward curvature near the distal end of each arm to conform to the sole and the foot. In the embodiment of FIG. 8A, the energy return plate 160 is formed from a single plate of a carbon fiber reinforced polymer, but other embodiments can be formed from one or more resilient materials, including polymers and metals, and can be formed from multiple pieces.

In the energy return plate 160 of FIG. 8A, the arms 164, 166, 168, and 170 form an "H" shaped configuration with the central portion 162 forming the horizontal member of the "H". Each of the arms 164, 166, 168, and 170 has two ends with one end integrally formed with the central portion 162, and the other end being free to move independently from the other arms in the energy return plate 160. The configuration of the energy return plate 160 is cantilevered since each of the arms 164-170 is connected to the central portion 162 and the other arms at only one end. Each of the arms 164-170 is a leaf spring that is configured to deform and store mechanical energy when the athletic shoe 100 contacts the ground during a stride and to return at least some of the mechanical energy to the foot as the athletic shoe 100 leaves the ground.

Figure 6:
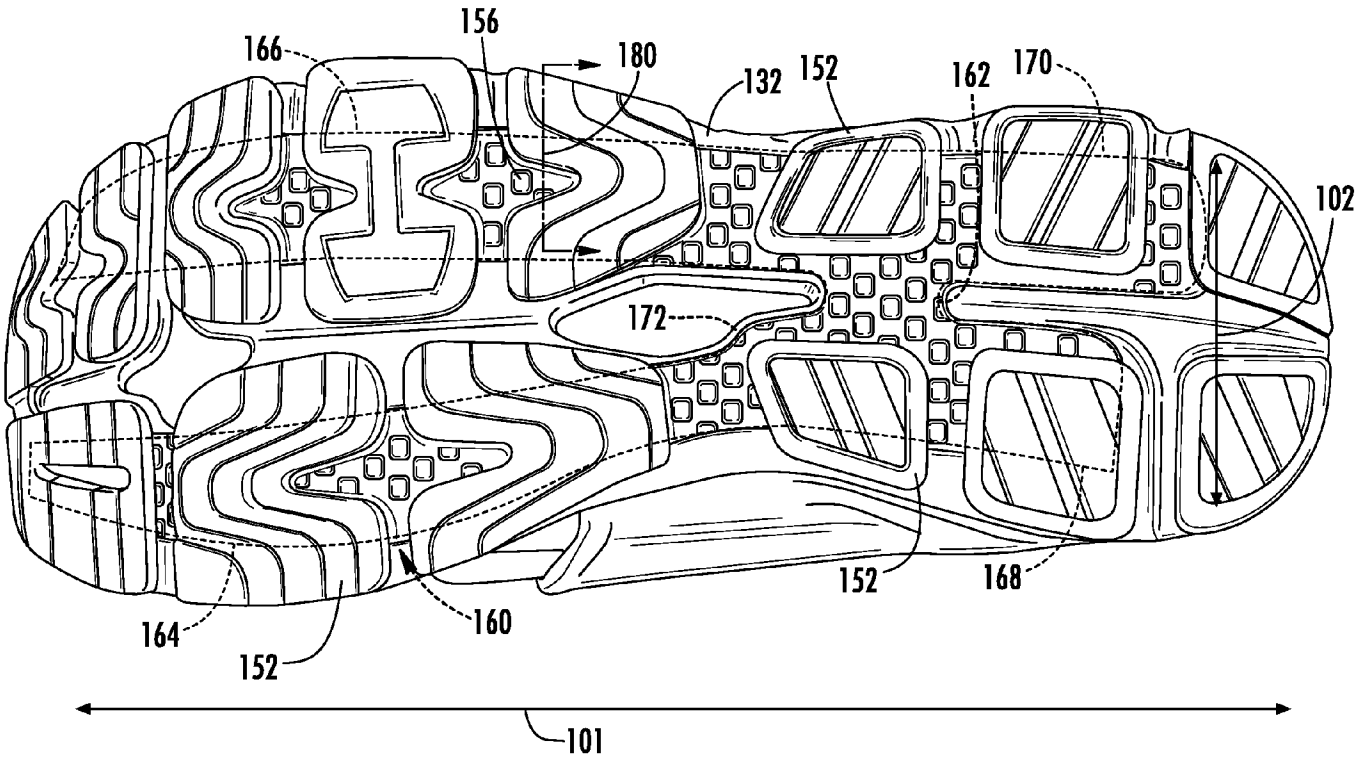
FIG. 6 is a bottom view of the athletic shoe of FIG. 1-FIG. 5 depicted a sole and tread of the athletic shoe with an outline view of the energy return plate incorporated in the sole.

FIG. 6 and FIG. 9 depict the energy return plate 160 in the sole 132 of the athletic shoe 100. FIG. 6 depicts the outline of the energy return plate 160 incorporated into the sole 132. The sole 132 fully encloses the energy return plate 160, which extends along the length of the sole 132 in parallel with the length of the foot cavity 140. In the athletic shoe 100, the central portion 162 of the energy return plate 160 is positioned posterior to the forefoot region under a portion of the foot cavity where the midfoot meets the heel. In alternative configurations, the central portion 162 can be positioned farther in the anterior direction under the midfoot region or farther in the posterior direction under the heel region. The configuration of the forefoot and heel arms in the energy return plate 160 is asymmetrical along the length 101 of the athletic shoe 100. For example, the medial forefoot arm 164 extends further toward the forefoot end of the athletic shoe 100 than the lateral forefoot arm 166. Additionally, the medial forefoot arm 164 includes a bulge 172 that increases the rigidity of the medial forefoot arm 164 near the central portion 162. In the embodiment of the energy return plate 160 used in the athletic shoe 100, the lateral heel arm 170 extends in the posterior direction under the heel farther than the medial heel arm 168. The shapes, curvatures, and sizes of each arm in the energy return plate 160 can be varied to fit various footwear designs.

FIG. 9 depicts various layers in the sole 132 in more detail in a cross-sectional view of a selected portion of the athletic shoe 100 taken along line 180. The sole 132 depicted in FIG. 9 is exemplary of one configuration that incorporates an energy return plate. The sole 132 includes treads 152, a resilient layer 154 that is joined with a transparent polymer 156, the energy return plate 160, the midsole board 148, and an insole layer 144. The resilient layer 154 and treads 152 are referred to as outsole layers that form portions of the exterior of the sole 132. Different designs of soles can include a larger or lesser number of layers in the outsole and can be formed from various combinations of materials. The treads 152 engage the ground when the athletic shoe 100 is worn and are typically formed from vulcanized rubber. The treads 152 are positioned and shaped to provide a firm grip between the athletic shoe 100 and the ground during a stride.

The resilient layer 154 provides structural support for the sole 132 and engages the treads 152 and a bottom side of the energy return plate 160. The resilient layer 154 can be formed from various materials including vulcanized rubber and polyurethane foam. The design of the athletic shoe 100 optionally includes a transparent polymer layer 156 that is co-planar with portions of the resilient layer 154. The transparent polymer layer 156 encloses the energy return plate 160 in areas where the resilient layer 154 does not extend across the entire width of the sole 132. The transparent polymer layer 156 visually exposes portions of the energy return plate 160 for aesthetic purposes, and seals the energy return plate from dirt or other contaminants that contact the sole 132. Other embodiments of the athletic shoe 100 omit the transparent polymer layer 156 and include a resilient layer 154 that covers the bottom side of the energy return plate 160.

The midsole board 148 engages the resilient layer 154 and a top side of the energy return plate 160. The midsole board 148 is also attached to the welt 138, heel member 104 and forefoot member 120 as described above. The insole layer 144 is positioned over the midsole board 148 and forms the bottom of the foot cavity 140 in the athletic shoe 100. The insole layer 144 provides support, cushioning, and shock absorption for the foot and is typically formed from one or more layers of compression foam, silicone gels, or other cushioning materials. In some embodiments the insole layer 144 can be removed from the athletic shoe 100 and replaced with a different insole.

Figure 8B:
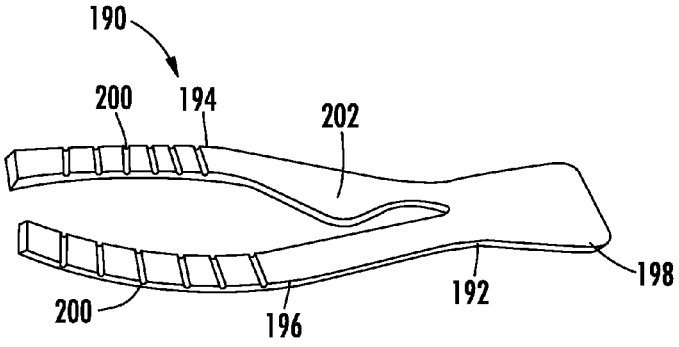
FIG. 8B is a view of another embodiment of an energy return plate that is incorporated in an article of footwear.

FIG. 8B depicts an alternative energy return plate 190. The energy return plate 190 includes a single central portion 192 that extends in the posterior direction to a heel end 198. A medial forefoot arm 194 and lateral forefoot arm 196 extend from the central portion 192 along the medial and lateral sides of the foot cavity under the midfoot and forefoot regions of the foot. In the energy return plate 190, both the medial and lateral forefoot arms include a plurality of indentations 200 formed through the top side of the energy return plate 190. The indentations 200 enable a uniform deformation of both the medial and lateral forefoot arms 194 and 196, respectively, during a stride. Different embodiments of the energy return plates 190 and 160 optionally include one or more indentations in both the forefoot and heel arms. The indentations 200 are arranged transverse to the length of the foot cavity 101 to accommodate deformation of either or both of the medial and lateral forefoot arms 194 and 196 during a stride. The medial and lateral forefoot arms are asymmetric in the embodiment of the energy return plate 190 with a bulge 202 that increases the rigidity of the medial forefoot arm 194 near the central portion 192. The energy return plate 190 is incorporated into the sole of an article of footwear in a similar manner to the energy return plate 160 depicted above.

The energy return plate 190 is formed in a "Y" shaped configuration, with the forefoot arms 194 and 196 forming the forked members of the "Y" and the central portion 192 and the central portion 192 forming the base of the "Y" shape. The forefoot arms are both connected at only one end to the central portion 192 in a cantilevered configuration. The central portion 192 also serves as a single heel arm extending under the heel region of a foot in the athletic shoe 100. The arms 194 and 196 and the central portion 192 are each a leaf spring that is configured to deform and store mechanical energy when the athletic shoe 100 contacts the ground during a stride and to return at least some of the mechanical energy to the foot as the athletic shoe 100 leaves the ground.

Figure 10A:
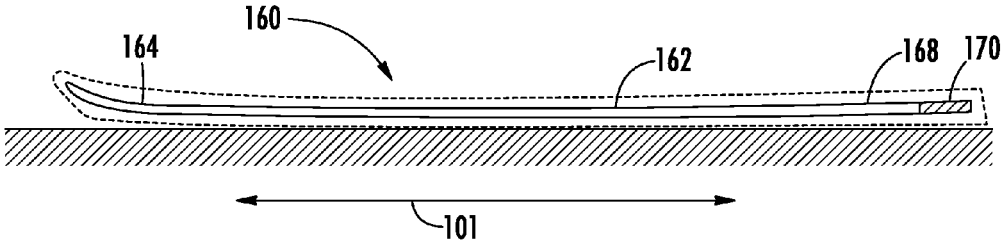
FIG. 10A is a side view of the energy return plate of FIG. 8A depicting the configuration of the energy return plate when the athletic shoe lies flat on a surface.

FIG. 10A depicts the energy return plate 160 in isolation when the athletic shoe 160 lies flat on surface such as the ground. In FIG. 10A, the forefoot arms 164 and 162 (hidden behind forefoot arm 164 in FIG. 10A) and heel arm 168 and 170 are each in an un-deformed position with no biasing force applied to the energy return plate 160. During a stride, each of the arms 164-170 deforms to absorb mechanical energy from the stride, and then return at least a portion of the mechanical energy when the energy return plate returns to the un-deformed configuration.

Figure 10B:
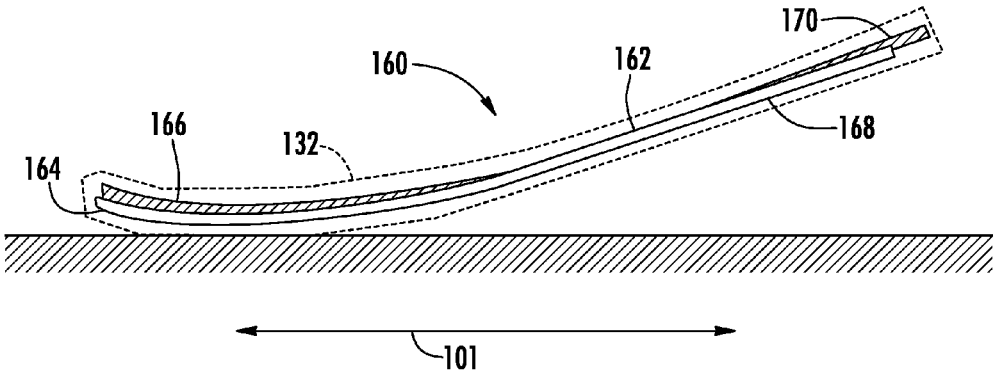
FIG. 10B is a side view of the energy return plate of FIG. 8A depicting how the energy return plate flexes during a pronated stride.

FIG. 10B depicts the energy return plate 160 in isolation during a pronated stride. A pronated stride occurs when the heel initially contacts the ground on the lateral side of the foot and then rolls inwards toward the medial side of the foot during the stride. During a pronated stride, the foot places an uneven force on the medial and lateral sides of the energy return plate 160. The medial forefoot arm 164 and medial heel arm 168 of the energy return plate deform at a somewhat greater rate than the lateral forefoot arm 166 and lateral heel arm 170 in the energy return plate 160 in response to the force of the foot. Since the foot angles inward toward the medial side during a pronated stride, the medial forefoot arm 164 and medial heel arm 168 are positioned at a lower level than the lateral forefoot arm 166 and lateral heel arm 170.

The cantilevered configuration of the forefoot arms 164 and 166 enables the medial forefoot arm 164 to deform to a greater degree than the lateral forefoot arm 166 since the forefoot ends of both arms are free ends that are only connected to each other through the central portion 162. The cantilevered configuration of the heel arms 168 and 170 enables the heel arm 168 to deform to a greater degree than the lateral heel arm 170 as well. Both the medial and lateral sides of the energy return plate 160 experience some deformation as depicted in FIG. 10B. As the athletic shoe 100 leaves the ground, the energy return plate 160 and sole 132 return to an un-deformed configuration and energy stored in the energy return plate urges the athletic shoe 100 and the foot of the wearer upward as the foot lifts during the stride.

Figure 10C:
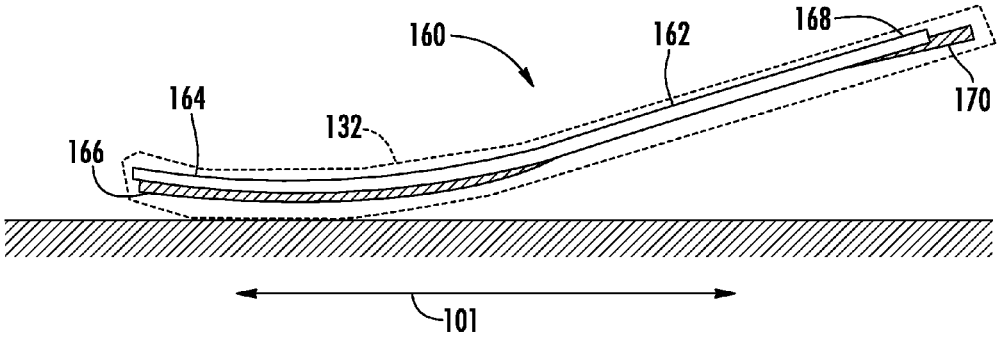
FIG. 10C is a side view of the energy return plate of FIG. 8A depicting how the energy return plate flexes during a supinated stride.

FIG. 10C depicts the energy return plate 160 in isolation during a supinated stride. In a supinated stride, the heel initially contacts the ground on the lateral side and then does not roll inwardly toward the medial side by a significant amount during the stride. During a supinated stride, the foot places an uneven force on the medial and lateral sides of the energy return plate 160 with a different distribution of force than in the pronated stride. The lateral forefoot arm 166 and lateral heel arm 170 deform at a somewhat greater rate than the medial forefoot arm 164 and medial heel arm 168 in the energy return plate 160 in response to the force of the foot.

Since the lateral side of the foot experiences a greater force during the supinated stride, the medial forefoot arm 164 and medial heel arm 168 are positioned at a higher level than the lateral forefoot arm 166 and lateral heel arm 170. Both the medial and lateral sides of the energy return plate 160 experience some deformation as depicted in FIG. 10C. The cantilevered configuration of the arms 166-170 in the energy return plate 160 enables the lateral forefoot arm 166 and lateral heel arm 170 to deform to a greater degree than the corresponding medial forefoot arm 164 and medial heel arm 168. As the athletic shoe 100 leaves the ground, the energy return plate 160 and sole 132 return to an un-deformed configuration and energy stored in the energy return plate urges the athletic shoe 100 and the foot of the wearer upward as the foot lifts during the stride.

While FIG. 10B and FIG. 10C depict the energy return plate 160 during pronated and supinated strides, respectively, another form of stride has "neutral" pronation in which the force of the stride is distributed approximately evenly between the medial and lateral arms of the energy return plate 160. The medial and lateral arms in the energy return plate 160 deform by approximately equal amounts during a neutrally pronated stride.

The upward force from the energy return plate 160 is also referred to as a "rebound" force, and the rebound force reduces the energy and effort needed to lift the foot during the next stride. The configuration of the energy return plates 160 and 190 enable the athletic shoe 100 to deliver a rebound force evenly across the foot and to accommodate wearers with both pronated and supinated strides.

The energy return plate embodiments described above provide several advantages to a person wearing the athletic shoe 100. First, the energy return plates extend for substantially the entire length of the foot extending from under the heel to under some or all of the toes of the foot in the foot cavity. The length of the energy plate enables the energy plate to store more mechanical energy for release as the athletic shoe leaves the ground during a stride. Second, the energy return plate provides return energy to both the medial and lateral sides of the foot. Third, the asymmetric configuration of the energy return plate accommodates wearers who have both pronated and supinated strides.

Although the present invention has been described with respect to certain preferred embodiments, it will be appreciated by those of skill in the art that other implementations and adaptations are possible. Moreover, there are advantages to individual advancements described herein that may be obtained without incorporating other aspects described above. Therefore, the spirit and scope of any appended claims should not be limited to the description of the preferred embodiments contained herein.

What is claimed is:

1. An article of footwear comprising:

a sole defining a lateral side and a medial side;

an upper attached to the sole, the upper and the sole defining a foot cavity; and a resilient member positioned within the sole, the resilient member comprising a plurality of arms including a medial arm extending along the medial side of the sole and a lateral arm extending along the lateral side of the sole, wherein an end of the medial arm is connected to an end of the lateral arm, the resilient member further including at least one indentation in the medial arm or the lateral arm, the at least one indentation extending in a direction transverse to the length of the sole on a side of the resilient member that faces the foot cavity.

2. The article of footwear of claim 1, the sole further comprising an insole and an outsole, wherein the resilient member is embedded in the sole between the insole and the outsole.

3. The article of footwear of claim 1, the sole further defining a forefoot region, a midfoot region, and a heel region, the medial arm extending along the medial side of the sole from the midfoot region to the forefoot region of the sole, and the lateral arm extending along the lateral side of the sole from the midfoot region to the forefoot region of the sole.

4. The article of footwear of claim 3 wherein the end of the medial arm is connected to the end of the lateral arm in the midfoot region of the sole.

5. The article of footwear of claim 4, the resilient member further comprising a central portion at least partially positioned in the heel region of the sole and connecting the medial arm and the lateral arm, the medial arm and lateral arm extending outward from the central portion.

6. The article of footwear of claim 5 further comprising at least one posterior arm extending outward from the central portion into the heel region of the sole.

7. The article of footwear of claim 6 wherein the resilient member is an H-shaped spring plate, and wherein the at least one posterior arm includes a first posterior arm on the medial side of the sole and a second posterior arm on the lateral side of the sole.

8. The article of footwear of claim 1 wherein the resilient member is a Y-shaped spring plate.

9. The article of footwear of claim 1, the sole further comprising an insole and an outsole, wherein the resilient member is embedded between the insole and the outsole.

10. The article of footwear of claim 1 wherein the resilient member is comprised of carbon.

11. An article of footwear comprising:

an upper;

a sole attached to the upper, the sole including a forefoot region, a midfoot region, and a heel region, wherein the upper and the sole form a foot cavity; and a resilient member embedded in the sole, the resilient member including a first cantilever arm, a second cantilever arm, a third cantilever arm, a fourth cantilever arm and a central portion, the central portion at least partially positioned in the midfoot region of the sole, the first cantilever arm and the second cantilever arm extending from the central portion into the forefoot region of the sole, the third cantilever arm and the fourth cantilever arm extending from the central portion into the heel region of the sole, the first and third cantilever arms extending along a lateral side of the sole and the second and fourth cantilever arms extending along a medial side of the sole, the resilient member further including at least one indentation extending in a direction transverse to the length of the sole on a side of the resilient member that faces the foot cavity, the at least one indentation configured to promote deformation of the resilient member in response to the force on the sole.

12. The article of footwear of claim 11 wherein the at least one indentation is provided on one of the first, second, third or fourth cantilever arms.

13. The article of footwear of claim 12 wherein the at least one indentation includes a plurality of indentations on the first and second cantilever arms.

14. An article of footwear configured for a foot of a human wearer, the article of footwear comprising:

a sole including a medial side, a lateral side, a forefoot region and a heel region;

an upper attached to the sole, the upper and sole defining a foot cavity configured to receive the foot; and a spring plate positioned within the sole, the spring plate comprising:

a central member positioned posterior to the forefoot region of the sole;

a first medial arm extending from the central member to the forefoot region of the sole on a medial side of the sole;

a first lateral arm extending from the central member to the forefoot region of the sole on a lateral side of the sole;

at least one posterior arm extending from the central member to the heel region of the sole; and at least one indentation in the first medial arm or the first lateral arm, the at least one indentation extending in a direction transverse to the length of the sole on a side of the spring plate that faces the foot cavity;

wherein the first medial arm and the first lateral arm are configured to resiliently deform in response to a force on the sole during a stride of the wearer and resiliently recover in response to the force being removed from the sole, the at least one indentation configured to promote deformation of the spring plate in response to the force on the sole.

15. The article of footwear of claim 14, the at least one posterior arm in the spring plate further comprising:

a second medial arm extending from the central member to the heel region on the medial side of the sole; and a second lateral arm extending from the central member to the heel region on the lateral side of the sole.

16. The article of footwear of claim 14, the central member extending into the heel region.

17. The article of footwear of claim 14, wherein the spring plate is a carbon fiber reinforced polymer member.

18. The article of footwear of claim 14, the first medial arm being configured to deform to a greater degree than the first lateral arm during a pronated stride of the human wearer.

19. The article of footwear of claim 14, the first medial arm further comprising an inwardly extending bulge positioned proximate to the central member on the first medial arm.

* * * * *